United States Patent [19]

Warmath

[11] 3,954,179

[45] May 4, 1976

[54] CONTAINER

[75] Inventor: John G. Warmath, Brooklyn, N.Y.

[73] Assignee: Deena Packaging Industries, Inc., Long Island, N.Y.

[22] Filed: Mar. 20, 1974

[21] Appl. No.: 452,911

[52] U.S. Cl. ..... 206/528; 229/44 R; 220/337

[51] Int. Cl.[2] ..... B65D 83/04; B65D 43/16; B65D 5/66

[58] Field of Search ..... 206/42; 220/315, 333, 220/337, 339; 229/44 R, 2.5

[56] References Cited

UNITED STATES PATENTS

| | | | |
|---|---|---|---|
| 1,450,690 | 4/1923 | Leopold | 229/44 R |
| 3,294,222 | 12/1966 | Hodgson | 206/42 |
| 3,381,850 | 5/1968 | Haugen | 220/337 |

FOREIGN PATENTS OR APPLICATIONS

| | | | |
|---|---|---|---|
| 457,256 | 1968 | Switzerland | 206/42 |

*Primary Examiner*—William Price
*Assistant Examiner*—Douglas B. Farrow
*Attorney, Agent, or Firm*—Marn & Jangarathis

[57] ABSTRACT

There is disclosed a container integrally comprised of a cover member and body member having safety latching means formed on walls thereof and having a compressioned-biased hinge means formed to urge such members in locked interrelationship in a closed position.

6 Claims, 10 Drawing Figures

FIG. 1
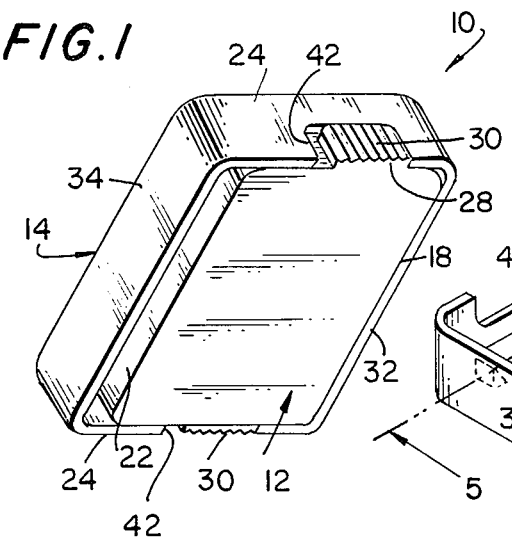
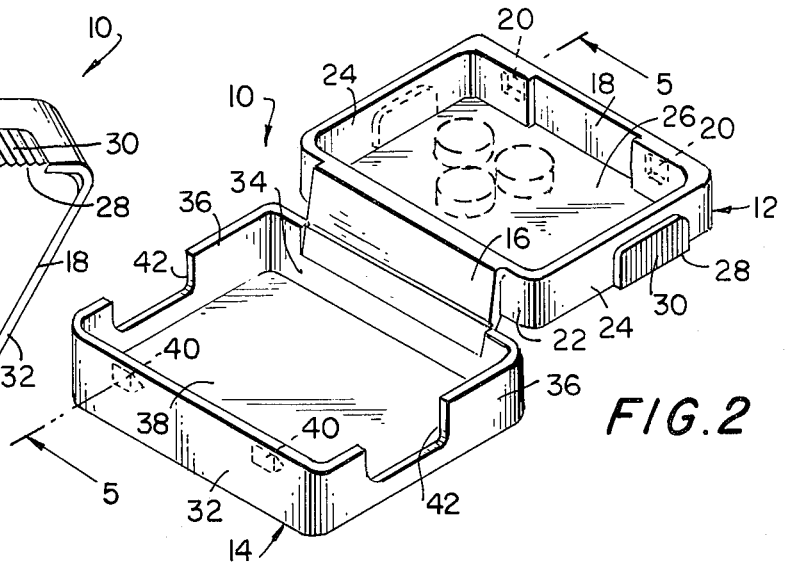
FIG. 2
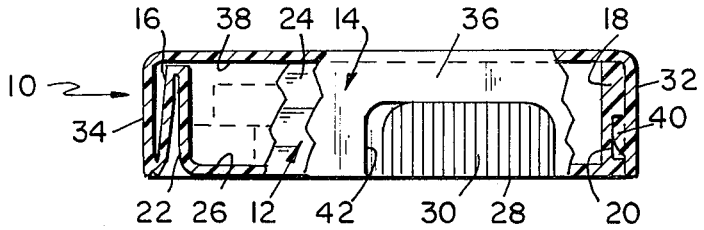
FIG. 3
FIG. 4
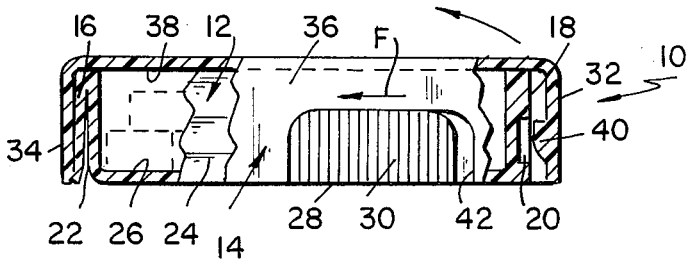
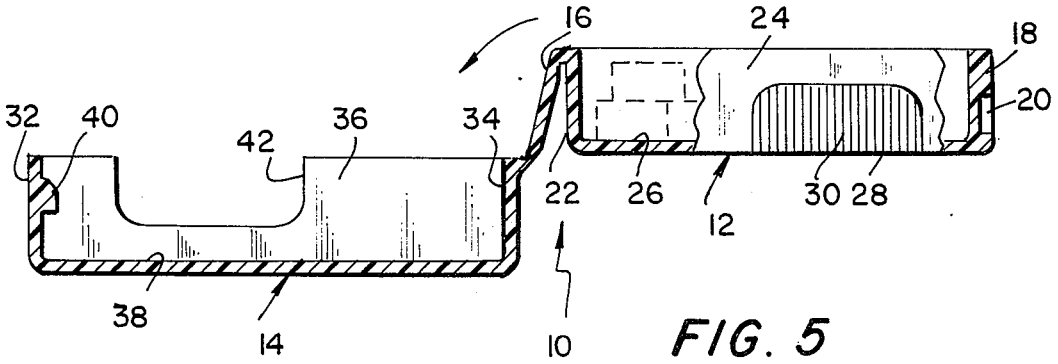
FIG. 5

FIG. 6
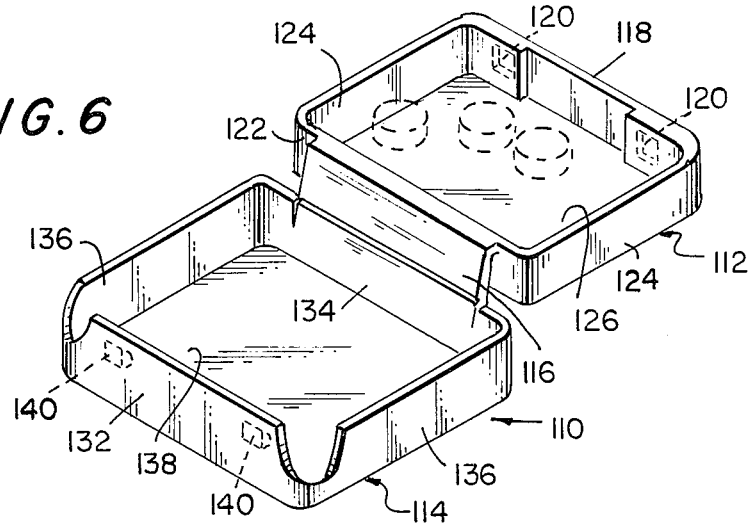
FIG. 7
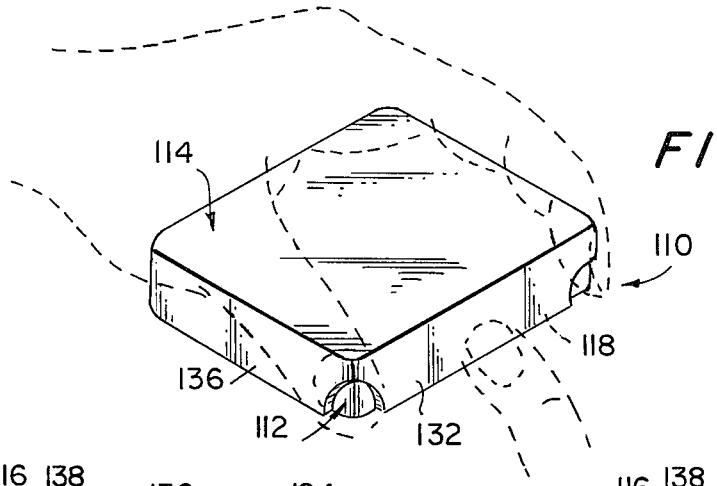
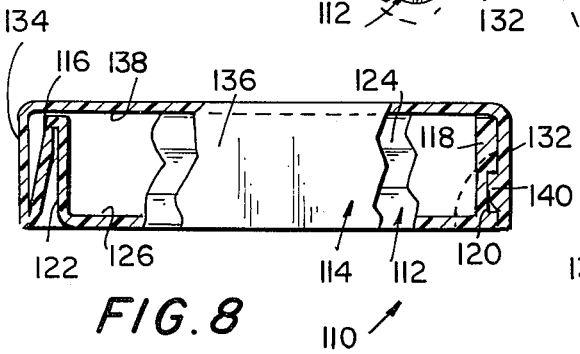
FIG. 8
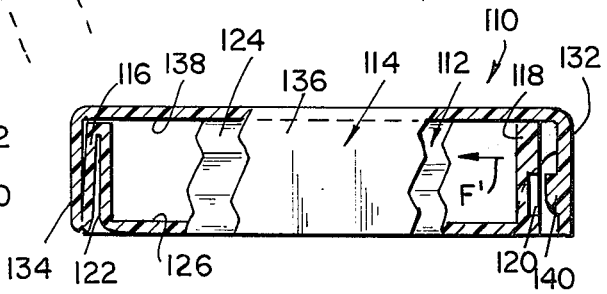
FIG. 9
FIG. 10
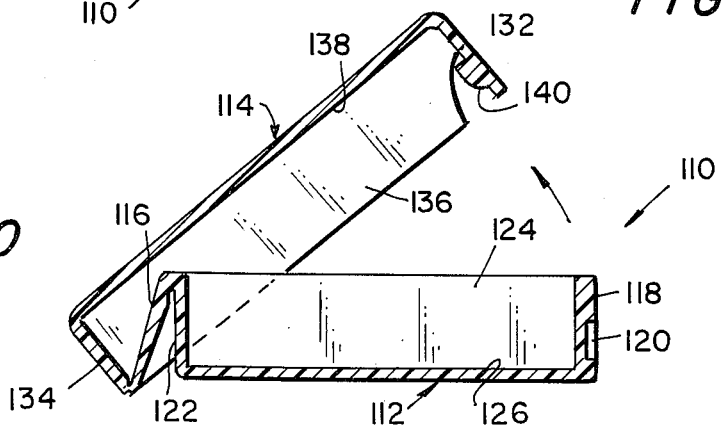

CONTAINER

This invention relates to containers, and more particularly to a container for tablets and the like having a safety latch which minimizes inadvertent opening of the container.

BACKGROUND OF THE INVENTION

The container art is replete with diverse types of containers or recepticals for tablets, pills, capsules and the like. In certain instances opening of such a container is effected by hingeably pulling the cover off the body normally locked to one another. Other containers are opened by pressing the cover to the body at specified locations to achieve unlocking whereby the cover may thereafter be hingeably rotated from the body (See, e.g. U.S. Pat. No. 2,271,630 to Dahlgren). Generally, the opening of such a container may be easily effected inadvertently particularly by a child, thereby permitting access to the contents thereof which if injested may be deleterious or fatal.

OBJECTS OF THE INVENTION

An object of the present invention is to provide a novel container having a safety lock assembly.

A further object of the present invention is to provide a novel container having a safety lock assembly which minimizes the inadvertent opening thereof.

Still another object of the present invention is to provide a novel container having a safety lock assembly and formed of one-piece construction.

SUMMARY OF THE INVENTION

These and other objects of the present invention are achieved by a container comprised of a top or cover member and a bottom on body member having latching means formed on walls thereof and having a compressioned-biased hinge means unitarily formed on opposed walls of each member.

BRIEF DESCRIPTION OF THE DRAWINGS

A better understanding of the present invention as well as other objects and advantages thereof will become apparent upon consideration of the detailed disclosure thereof, especially when taken with the accompanying drawings, wherein like numerals designate the like parts throughout; and wherein:

FIG. 1 is an isometric bottom view of one embodiment of present invention illustrating a container in a closed position.

FIG. 2 is an isometric top view of the container of FIG. 1 in an opened position;

FIG. 3 is an elevational side view in partial cross-section of the container of FIG. 1;

FIG. 4 is an elevation view in partial cross-section of the container of FIG. 1 in a mode for hingeably rotating the cover member from the body member.

FIG. 5 is a sectional view of the container of FIGS. 1 to 4 taken along the lines 5-5 of FIG. 2.

FIG. 6 is an isometric top view of another embodiment of the present invention in an opened position;

FIG. 7 is an isometric view of the container of FIG. 6 illustrating the method of disabling the latching means;

FIG. 8 is an elevational side view in partial cross-section of the container of FIG. 6;

FIG. 9 is an elevation view in partial cross-section of the container of FIG. 6 in a mode for hingeably rotating the cover member from the body member; and FIG. 10 is a cross-section view of the container of the FIGS. 6 to 9 in a partially opened position.

DETAILED DESCRIPTION OF THE DISCLOSURE

Referring to FIGS. 1 to 5 illustrating one embodiment of the present invention, there is provided a container generally indicates as 10, comprised of a top or cover member and body member, generally indicates as 14 and 12, respectively, hingeably affixed to one another by a connecting member 16. The body member 12 in which a product is disposed is formed of a front wall 18 including slot portions 20 on the outer surface thereof, a rear wall 22, side wall 24 and a bottom 26. The outer surface of each side wall 24 is formed with a rectangularly-shaped raised portion 28 including serrated surface 30 as more fully hereinafter described. The cover member 14 is formed by a front wall 32, a rear wall 34, side walls 36 and a top 38. The inner surface of the front wall 32 is formed with inwardly extending pin members 40 whereas each side wall 36 is formed with a cut-out portion 42.

As hereinabove discussed, the body and top members 12 and 14, respectively, are integrally formed together with the connecting compression biased member 16. The connecting member 16 cooperates with rear walls 22 and 34 of the body and top members 12 and 14, respectively, to cause the inner surface of the front wall 32 of the top member 14 to butt-up against the outer surface of the front wall 18 of the body member 12 whereby the pin members 40 of the top member 14 latcheably engage the slots 20 of the front wall of the body member 12. Thus, in this closed position, by the compression force of the member 16 as particularly illustrated by FIG. 3, the top and body member 12 and 14 are in a locked position by the compressional force derived by the cooperation of the connecting member 16 with associated walls of the body and top members 12 and 14, as hereinabove described.

Thus, referring to FIG. 4, if a lateral force (as illustrated by the arrow F) of sufficient magnitude is exerted on the raised portions 28 of the side walls of the body member 12 while retaining the top member 14 in a stationary position, the body member 12 is caused to move until the pin members 40 of the top member 14 are disengaged from the slots 20 provided in the outer surface of the front wall 18 of the body member 12 to permit thereby hingeable rotation of the top member 14 away from the body member 12 thereby assuming the relative position therebetween, such as illustrated in FIG. 5. The container 10 may be readily closed by urging one member against the other member with sufficient force until such members latcheably engage another in the manner hereinabove described.

Referring to FIGS. 6 to 10 illustrating another embodiment of the present invention, there is provided a container, generally indicated as 110, comprised of a top or cover member and a body member, generally indicated as 114 and 112, respectively, hingeably affixed to one another by a connecting spring tension member 116. The body member 112, in which a product is disposed, is formed by a front wall 118 including slot portions 120 on the outer surface thereof, a rear wall 122, side walls 124 and a bottom 126. The cover member 114 is formed by a front wall 132, a rear wall 134, side walls 136 and a top 138. The inner surface of the front wall 132 is formed with pin members 140. A portion of the side and front walls is excised at the intersection of each side wall 136 with the front wall 132 to permit access to the side wall and front walls 124 and 18, respectively, of the body member 112 when the container 110 is in a closed mode. As hereinabove discussed the body and top members 112 and 114, respectively, are integrally formed with the connecting member 116.

The connecting member 116 cooperates with the rear walls 122 and 134 of the body and top members 112 and 114, respectively, to cause the body member 112 to be biased within the top member 114 such that the pin members 140 of the top member 114 are latcheably positioned within the slots 120 of the body member 112, as illustrated in FIG. 8. Thus, in the closed position particularly, illustrated by FIG. 8, the top and body member 112 and 114 are locked and may be opened in a manner necessitating a compressional force opposite to the compressional force resulting from the cooperation of the connecting member 116 with associated walls of the body and top members.

Thus, referring to FIGS. 7 and 9, if a lateral force (as illustrated by the arrow F in FIG. 9) of sufficient magnitude is exerted on the body member 112 at the excised portions of the top member 114 (such as by the thumb and index fingers illustrated by the dotted lines) while retaining the top member 114 in a stationary position, the body member 112 is caused also to move until the pin members 140 of the member 114 are disengaged from the slots 120 provided in the outer surface of the front wall 118 of the body member 112 to permit thereby hingeable rotation (FIG. 10) of the top member 114 from the body member 114 thereby assuming the relative position therebetween as illustrated in FIG. 6. The container 110 may be readily closed by exerting one member against the other member with sufficient force until such members latcheably engage one another in the manner hereinabove described.

The container of the present invention is formed of a thermoplastic material capable of being made in thin sections suitable for creation of hinge effect, such as polyethylene, polypropylene and the like, generally utilizing injection moulding techniques however, it is understood to one skilled in the art that other molding techniques may be utilized.

While the method of opening the containers of the present invention is described with reference to the application of a compressional force in a direction opposite the compressional force produced by connecting the member 116 cooperating with the body and top members, it has been found that such a container may be opened by alternately placing a compressional force obliquely (i.e. on opposite corners) to the container whereby the pin members are sequentially disengaged from the slots. Additionally, it will be appreciated that the slot and the pin members may be disposed in diverse locations and that access to the body member may be provided by a cut out portion or portions in diverse locations of the top or cover member.

While the locking elements have been described as being formed on the front walls of the members, it will be understood that such locking elements may be formed on the side walls, or on a combination of the walls thereof.

What is claimed:

1. A molded integral container formed of a thermoplastic material which comprises:

a body member including a front wall, side walls, and a rear wall, said walls including a first element of a locking means;

a cover member including a front wall, side walls and a rear wall, said walls including a second element of the locking means; and a connecting member means formed to and integral with said rear walls of said body and cover members whereby said connecting member is compressionally disposed between said rear walls of said bottom member and cover member of said container in a closed assembly to engage thereby said elements of said locking means.

2. The container as defined in claim 1 wherein said elements of said locking means are formed on said front walls of said body and cover member.

3. The container as defined in claim 2 wherein said first element includes recessed portions and said second element includes pin member extending outwardly from the inner surface of said front wall of said cover member.

4. The container as defined in claim 1 wherein said side walls of said cover member include excised portions and wherein the outer surface of said side walls of said body member are formed with raised portion means dimensionally smaller than said excised portions of said side walls of said cover member to permit lateral and relative motion of said body member to said cover member.

5. The container as defined in claim 4 wherein said raised portions means includes a serrated outer surface.

6. The container as defined in claim 1 wherein said cover member is formed with an excised portion means to permit access to a wall of said body member.

* * * * *